US005510966A

United States Patent [19]

Konecny

[11] Patent Number: 5,510,966

[45] Date of Patent: Apr. 23, 1996

[54] DISPLAY AND STORAGE FIXTURE FOR STRINGS OF DECORATIVE LIGHTS

[76] Inventor: Francis C. Konecny, 14001 Sandhurst Dr. SW., Huntsville, Ala. 35803

[21] Appl. No.: 306,707

[22] Filed: Sep. 15, 1994

[51] Int. Cl.[6] ..... F21V 21/00

[52] U.S. Cl. ..... 362/249; 362/240; 362/238; 362/145

[58] Field of Search ..... 362/227, 238, 362/239, 240, 249, 250, 145, 806, 364, 365

[56] References Cited

U.S. PATENT DOCUMENTS 3,692,993 9/1972 Robinson ..... 362/249 X 4,821,158 4/1989 Mitten ..... 362/249

5,161,882 11/1992 Garrett ..... 362/249

5,311,414 5/1994 Branham, Sr. ..... 362/249

*Primary Examiner*—Stephen F. Husar

*Attorney, Agent, or Firm*—S. M. Clodfelter

[57] ABSTRACT

A fixture is provided for mounting to a structure, and which protectively encloses one or more strings of decorative lights when the lights are not in use, and which also serves to conveniently display the lights when in use. The fixture is constructed of an elongated, closed housing open on one side, with a closure movable to protectively enclose the lights within the fixture or to expose the lights for viewing.

15 Claims, 5 Drawing Sheets

DISPLAY AND STORAGE FIXTURE FOR STRINGS OF DECORATIVE LIGHTS

FIELD OF THE INVENTION

This invention relates to display and storage of strings of decorative lights, and particularly to fixtures permanently mounted to structures and including storage area for storing strings of Christmas lights when not in use, and for deploying the lights for display.

BACKGROUND OF THE INVENTION

One of the tasks of many, in preparation for the festivities of Christmas and New Years Eve, is the locating, untangling, and hanging of Christmas lights to exterior regions of houses and other structures. After the holidays, the lights are then taken down and stored until the next year.

Needless to say, this is a time-consuming and dangerous task, with a significant number of people being injured and even killed each year due to falls from ladders, or makeshift, unstable platforms of stacked articles while endeavoring to hang the strings of lights or take them down. Additionally, when not in use, the strings of lights themselves are prone to becoming tangled, and the light bulbs broken when it is attempted to untangle the electrical cords to which the lights are attached.

While Applicant is aware of an assortment of reels available for storing electrical extension cords, which would possibly work for storing strings of Christmas lights, he is unaware of any apparatus for permanently mounting strings of Christmas lights to the exterior of structures and which include a storage area for protectively storing the lights when not in use, and which render the lights quickly and conveniently deployable for display at the appropriate time.

Accordingly, it is an object of this invention to provide a fixture permanently mountable to a structure which protectively stores strings of decorative lights when not in use, and which further deploys the lights for display.

SUMMARY OF THE INVENTION

A storage and display fixture mountable to a structure for storing and displaying a string of decorative lights is provided, and includes an elongated enclosure having a first side and opposed second and third sides extending from opposed edges of the first side. Ends of the fixture are closed to weathering elements, forming a housing open on one side. A fourth side forms a movable closure for the housing, with the first, second, third, and fourth sides each having an inner surface. The string of lights is mounted along at least one of the inner surfaces of the fixture, so that the fourth side may be moved to protectively enclose the lights within the fixture or to expose the lights for viewing.

DETAILED DESCRIPTION OF THE DRAWINGS

Figure 1:
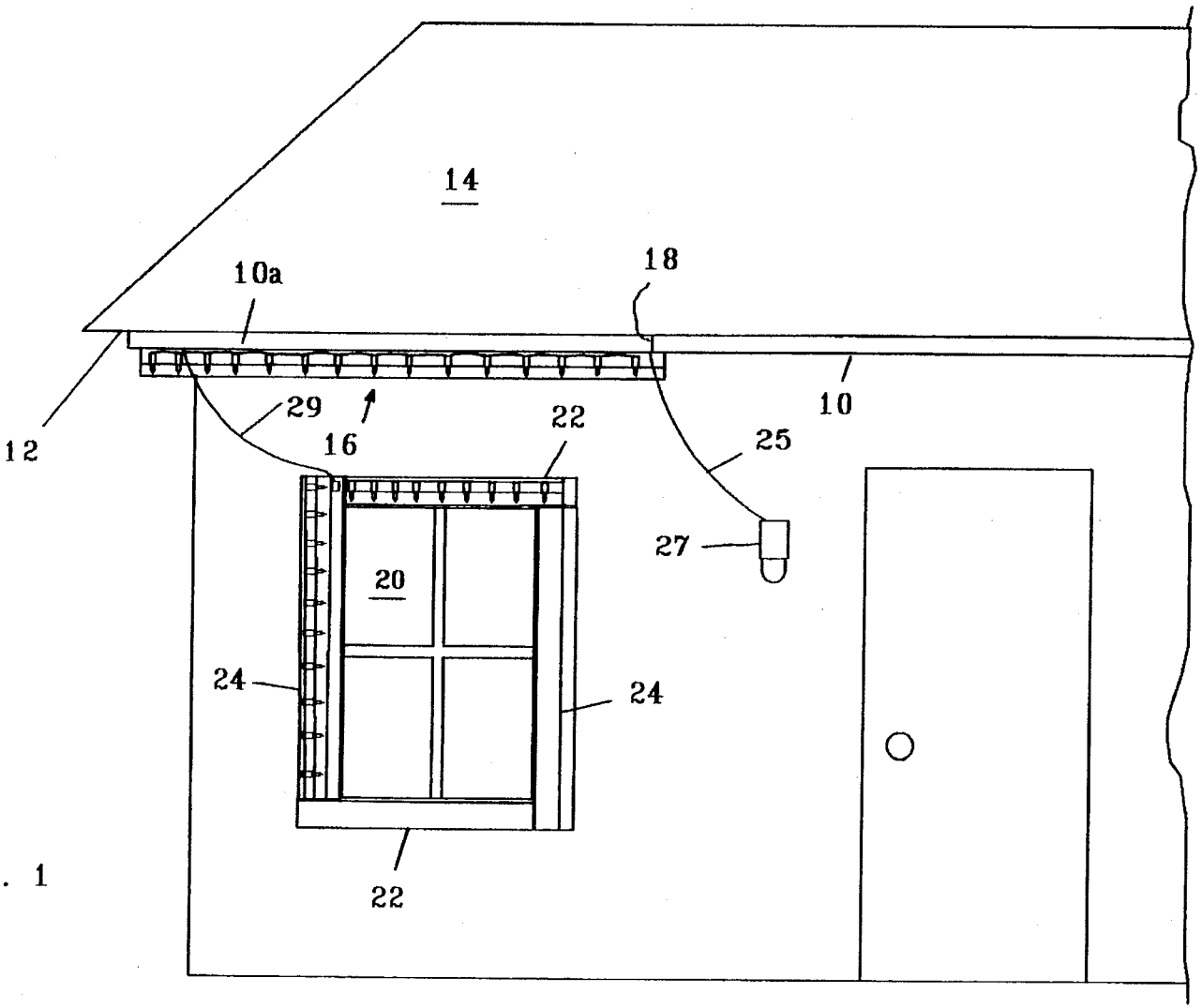
FIG. 1 is an illustration of a plurality of light fixtures of the present invention installed to the exterior of a house structure, and shown in opened and closed positions.

Referring initially to FIG. 1, decorative light fixtures 10 and 10*a* are shown installed under eaves 12 of a house 14. Fixture 10 is shown with the decorative lights in a stored position, and fixture 10*a* is shown with a string of decorative lights 16 deployed for viewing. Fixtures 10 and 10*a* are abutted together at point 18, minimizing or eliminating a gap therebetween. Around window 20, horizontal light fixtures 22 and vertical light fixtures 24 are shown, with the upper horizontal fixture 22 and the left vertical fixture 24 configured for viewing a string or strings of decorative lights, while the lower horizontal fixture 22 and the right vertical fixture 24 are shown as they would appear with the lights in a stored position. In each fixture 10, 10*a* and 22, 24, provisions are made for mounting a conventional electrical plug or receptacle that is typically fitted to opposed ends of the string of decorative lights, so that power may be coupled to the lights only when the fixture is opened. As such, and as a feature of the invention, the fixtures cannot be closed to store the lights without first disconnecting the plugs and receptacle, eliminating the possibility of a fire hazard due to a buildup of heat from illuminated, stored lights.

Electrical extension cords, such as cord 25, may be used for coupling the lights to a source of electrical power, such as a conventionally mounted, electrically switched exterior light fixture 27, which cord may also have a plurality of receptacle thereon for receiving a plurality of plugs from a point between strings of lights. For connecting between discrete strings of lights, such as those under eaves 12 and those around window 20, an extension electrical cord 29 may serve as a jumper conventionally plugged into respective ends of a string of lights at each end of a set of lights. Where short strings of lights are deployed around respective sides of a door or window, such as window 20, the strings of lights would be oriented so that when the fixtures were opened to display the lights, the plug of one string would be readily available to plug into a receptacle of an adjacent string, except where extension cord or jumper 29 is plugged to provide power to all the strings.

Figure 2:
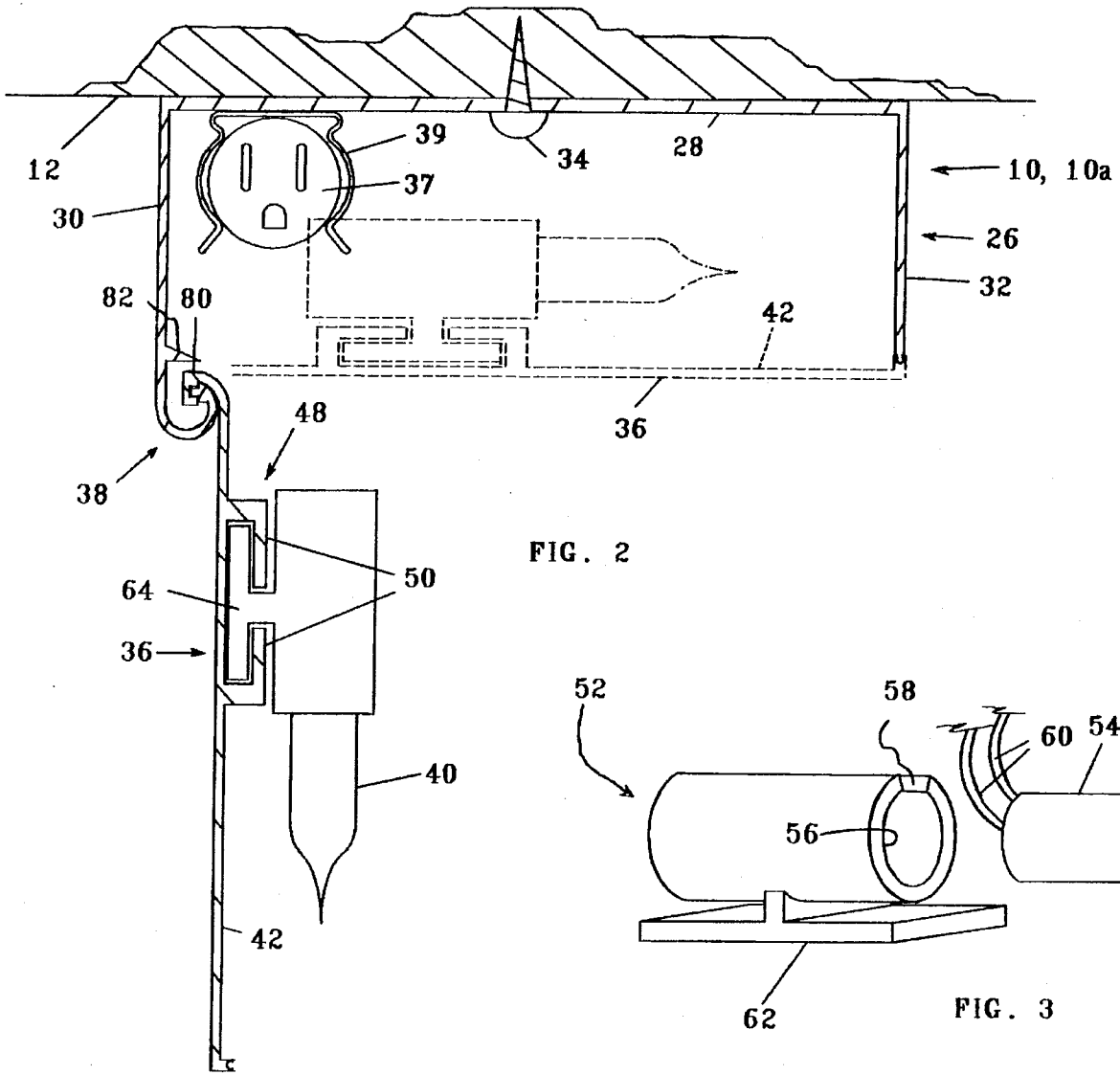
FIG. 2 is a lateral cut away view of a light fixture of the present invention adapted for horizontal mounting, and showing structural details thereof.

Referring now to FIG. 2, a lateral, cut-away view of enclosures 10 and 10*a* is shown. In this view, it is seen that the fixtures are each constructed having two main parts, an elongated, three sided enclosure 26 having a broad, upper side 28 and opposed, narrower, downwardly depending walls 30 and 32, with the fourth side opposed from upper side 28 being open. As stated, enclosures 10 and 10*a*, in this example, are shown mounted under eaves 12 of a house or other structure, as by fasteners 34.

The enclosures 26 are each provided with a display closure 36 of substantially a like length and width as the open side of enclosure 26. A hinged region 38 allows about 90 degrees of pivotal movement of closure 36 relative to enclosure 26 between an open position for displaying the lights (shown) and a closed position for protectively enclosing the string of lights within enclosure 26 (dashed lines). A string of electrical conductors (not shown) having a plurality of decorative lights 40 (only one shown) are mounted to inner side 42 of closure 36, with an electrical plug or receptacle 37 of the string of lights being mounted at one or both ends of enclosure 26, as by a spring clip 39. In a preferred embodiment, the enclosure and closure are constructed of a thermoplastic material by an extrusion process, with interlocking hinge portions on both the enclosure and closure being extruded integral therewith and supporting the closure substantially along its entire length. As such, enclosure 26 and closure 36 may be constructed of any length, as where customized lengths of extrusions are provided, or precut, standardized lengths of these extrusions may be provided for sale through retail outlets. Alternately, the closure and enclosure may be constructed of a thin gauge sheet metal by a process similar to that employed in the manufacture of rain gutters.

Figure 3:
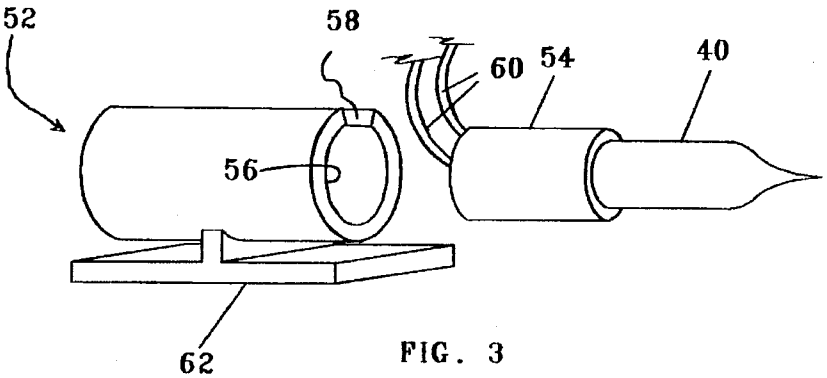
FIG. 3 is a pictorial view of a socket receptacle and light socket of the present invention showing structural details thereof.

For mounting a string of decorative lights in enclosures 10 and 10*a*, a track 48 (FIG. 2) having opposed, inwardly turned lips 50 is constructed on the inner side 42 of closure 36, track 48 extending longitudinally along inner side 42. As shown in FIG. 3, a plurality of receptacle 52 are also provided, one for each decorative, light socket 54, which receptacle 52 each constructed having an opening 56 for receiving a one of light sockets 54. A longitudinal slot 58 communicating with opening 56 may be provided where opening 56 is sized slightly smaller than light sockets 54, providing frictional engagement between receptacle 52 and socket 54, and also for providing clearance for electrical conductors 60 connected between the light sockets. Structure for engaging track 48 is provided on each receptacle 52, such as an inverted T-shaped region 62, which may be oriented generally perpendicular to opening 56. Regions 62 of the light receptacle 52 may be sized so as to slidably fit within the area 64 (FIG. 2) defined by lips 50 of track 48, and may frictionally or otherwise engage the T-shaped portions of the receptacle so as to prevent them from freely moving along track 48. Thus, a user would insert sockets 54 into openings 56 of respective receptacle 52, and then slide the T-shaped region 62 of each receptacle into area 64 of track 48, serially positioning the lights along inner region 42 of closure 36, as shown in FIG. 1 While the light sockets are particularly described as being mounted in receptacle which are in turn slidably mounted in a track of the closure, it is apparent that the light sockets may be mounted to the inner region of the closure using other types of fasteners which also hold the light sockets, or the receptacle or sockets may simply be bonded directly to the closure, as with hot melt glue. Additionally, where the closures are to be injection molded, receptacle for receiving the light sockets may be molded directly into the inner side of the closure. Further, while in the particular embodiment described herein the lights are mounted to the inner side of closure 36, the light sockets may be mounted in any orientation to any inner surface within enclosure 26 which is deemed practical for display, with closure 36 serving to cover the open side of enclosure 26, protecting the lights from weathering elements, or uncover the open side of enclosure 26 for the purpose of displaying the lights. Further, The receptacle and fixtures may be sized to receive and store miniature decorative lights (shown) or they may be sized to display and store larger decorative lights.

Figure 4:
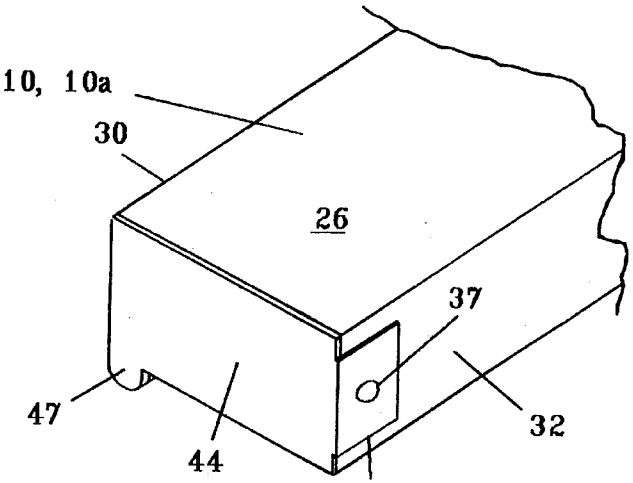
FIG. 4 is a pictorial view of an end closure in place over an open end of a fixture of the present invention.

Ends of enclosures 26 and hinged regions 38 which otherwise would be open to the elements are closed by end members 44 (FIG. 4), or by abutting the open ends of two adjacent enclosures together, as shown in FIG. 1, where the open ends of enclosures 10 and 10*a* are abutted at point 18. End members 44 are constructed having channel shaped members 46 adapted to be fitted along exterior side walls 30 and 32 of enclosure 26, and conventionally secured to enclosure 26 as by self tapping screws 37. A tab or ear 47 extending as shown from end member 44 serves to cover end regions of hinge portion 38, with the tab 47 and end member 44 serving to prevent moisture, which when frozen may bind the hinge portions, and other foreign material, from entering the hinge region and enclosure. Alternately, end members may take any form that would close the open ends of the enclosures and hinged regions, and may further be affixed to the enclosures by other techniques, such as recesses and detents, openings which are engaged by catches, or by bonding.

Figure 5:
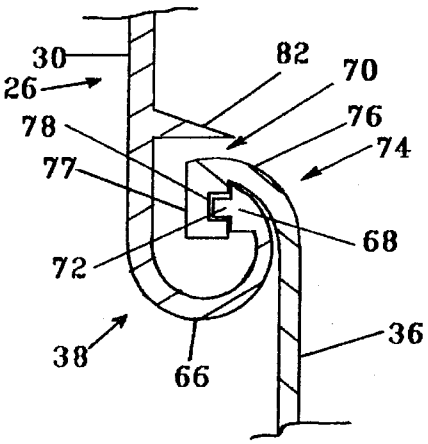
FIGS. 5 and 5*a* are cut-away views showing details of construction of a hinge region of the present invention.
Figure 5A:
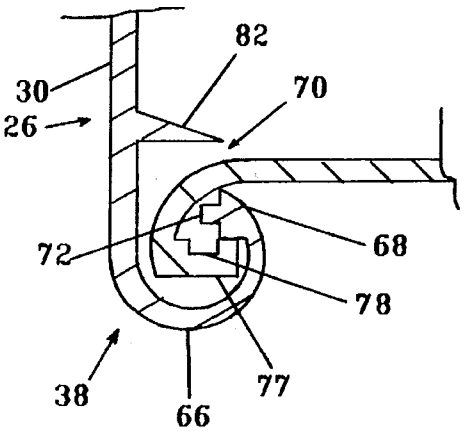

Referring now to FIGS. 5 and 5*a*, details of hinged regions 38 will now be discussed. Here, as described, region 38 is constructed having hinge components integral with both enclosure 26 and closure 36. On enclosure 26, downwardly depending side wall 30 is provided with edge region 66 which is rolled inwardly and upwardly through an arc of slightly more than 180 degrees, and which terminates with a thickened edge 68, leaving a gap 70 between thickened edge 68 and an inner side of wall 30. A lip or tongue 72 perpendicular to edge 68 is centered on edge 68 for providing a stop when closure 36 is opened, limiting downward pivoting motion of closure 36 to about 90 degrees. On closure 36, a rearward region 74 is provided with an outwardly rolled edge 76, which rolled edge 76 having an outer radius that substantially fits within the inner radius of rolled edge 66 of wall 30, and further extends through gap 70. Edge 76 terminates with a flattened lip 77 oriented generally in a plane parallel with closure 36, and is provided with a groove 78 longitudinally positioned in an inner side of lip 77. Groove 78 engages tongue 72 to provide a stop, locking closure 36 in an open position when closure 36 is pivoted about 90 degrees to display the decorative lights. When closure 36 is closed, groove 78 disengages from tongue 72 and closure 36 pivoted upward, with rolled edge 76 and flattened lip 77 rotating within the inner radius of rolled edge 66 to a position as shown in FIG. 5*a*. As such, region 66 of wall 30 and rolled edge 76 of closure 36 interlock to form a hinge about which closure 36 pivots. A tapered lip 82 may be provided as shown on the inner side of wall 30, for preventing moisture from entering the hinge, and which also prevents edge 76 from moving upward through gap 70 and becoming disengaged from edge 66. For closing closure 36 from the opened position, a rod or pole (not shown) may be configured at one end to engage closure 36 by means not shown, and be used to push closure 36 slightly upward, disengaging tongue 72 from groove 78, allowing the closure to be moved to the closed position.

As this type of hinge may be extruded integral with the enclosure and closure and assembled by axially sliding edge 76 into edge 66, and fixed in place by tab 47 (FIG. 4) of end closure 44 covering open ends of the hinge region, there is no need to provide a hinge as a separate component. Further, while in the preferred embodiment the hinged region 38 is configured for 90 degrees of movement, a differently configured hinge, such as a piano wire hinge or a plurality of smaller separate hinges, or living hinges, may alternately be used to allow greater pivotal movement, allowing the fixture to be mounted in other orientations than those shown and described herein.

Figure 8:
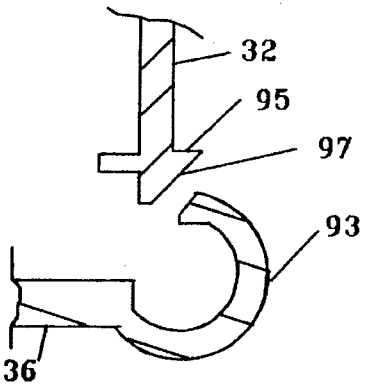
FIG. 8 is a cut-away view showing details of construction of a third embodiment of a latching mechanism of the present invention.
Figure 7:
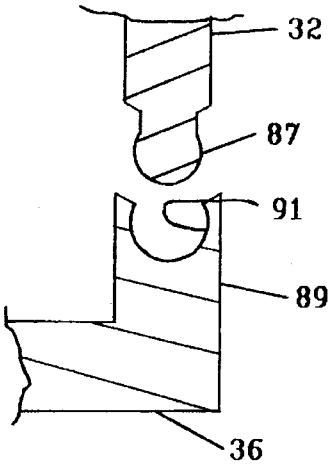
FIG. 7 is a cut-away view showing details of construction of a second embodiment of a latching mechanism of the present invention.
Figure 6:
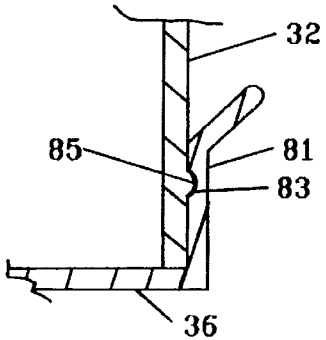
FIG. 6 is a cut-away view showing details of construction of one embodiment of a latching mechanism of the present invention.

For locking closure 36 in the closed position, protectively enclosing the decorative lights and precluding the possibility of inadvertently or deliberately leaving an extension cord plugged into the lights, which may present a fire hazard as described, latching mechanisms are disclosed herein which generally require interlocking edges between enclosure 26 and closure 36 along substantially the entire length of the fixture. In FIG. 6, an upwardly extending lip 81 is provided on closure 36 which lip 81 extending over an exterior side of wall 32. A longitudinally extending groove 83 is provided in an inner side of lip 81, with a mating, longitudinally extending ridge 85 provided on an exterior side of wall 32 adjacent a lower edge thereof. When pushed closed, groove 83 engages ridge 85, latching closure 36 closed. In FIG. 7, a cylindrical region 87 may be provided along one of the edges of wall 32, with a cylindrically shaped groove or socket region 91 provided in an upwardly extending lip 89 of closure 36. In this embodiment, region 87 extending along wall 32 releasably engages socket region 91 extending along lip 89 when closure 36 is pressed against wall 32. In FIG. 8, the edge of closure 36 is rolled upward in a hook-like shape 93, which engages an outwardly extending catch 95 having a ramp 97 positioned on wall 32. Here, as hook region 93 is pressed against ramp 97, wall 32 is slightly flexed inwardly to allow look region 93 to engage catch 95.

In any of these latch embodiments, knobs or other protrusions may be located on closure 36 where required to facilitate opening or closing of closure 36. Additionally, it is clear that the latching mechanisms cannot be snapped shut while an extension cord passes to the outside, as the cord presents an impediment to the interlocking regions of closure 36 and wall 32.

While three types of latches are particularly described for latching closure 36 with enclosure 26, it is apparent that other type releasable latches that engage along an entire length of the fixture may be alternately employed to secure closure 36 to cover the exposed side of enclosure 26. Further, other types of latches which effect coupling between closure 36 and wall 32 at points therealong may be employed, but are believed to be not as secure with respect to eliminating the fire hazard as described above.

Figure 10:
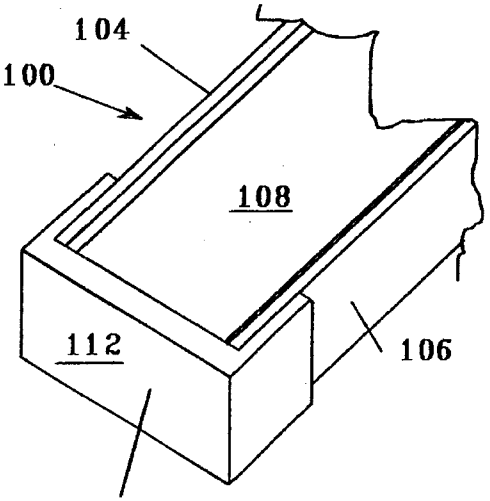
FIG. 10 is a pictorial view of an exterior region of the end closure as shown in FIG. 9 and FIGS. 9*a*–9*d*.

Decorative light fixtures 22 and 24, which are adapted to be mounted at other locations on the structure, such as around window 20, are constructed similarly to enclosures 10 and 10*a*, with the exception of the hinge configuration due to the fact that the closures thereof must move 180 degrees. Here, and referring to FIG. 9, a three sided enclosure 100 is provided having a first broad side 102 and opposed narrower sides 104 and 106 extending from opposite edges of broad side 102. A closure 108 is movable to cover the open side of enclosure 100, protectively enclosing the decorative lights and related components. As with the composite fixture comprising enclosures 10 and 10*a*, end closures 110 (FIGS. 9 and 10) are provided and secured as described to close ends of enclosure 100 to weathering elements and to exclude foreign objects from the interior of enclosure 100. Additionally, end closures 110 serve to enable pivoting movement of closure 108, as will be described. Further, as it is contemplated that this embodiment be mounted around doors and windows, the pivoting mechanism described herein allows for a unique and attractive appearance by locating the exterior side of the closure substantially flush with edges of side walls of the enclosure when in the closed position, and recesses the closure within the enclosure to position the lights substantially flush with or slightly recessed with respect to the side walls of the enclosure when in the open position.

Referring now to FIGS. 9 and 9*a*–9*d*, details of end closures 110 are shown. Here, as closure 108 must pivot 180 degrees and move to a recessed position within the enclosure to display the lights as described, and in order to improve the overall appearance of fixtures 22 and 24, a pivoting mechanism is provided wherein closure 108 is reversible and recessable in the open side of enclosure 100. As shown, upper and lower end closures 110 are each constructed having a generally U-shaped configuration, with end wall 112 being of a thicker dimension than sides 104 and 106 of enclosure 100. Each thicker wall 112 is provided with two grooves 114 and 116 in an inner surface thereof, with groove 114 being deeper and narrower, and extending in a plane generally parallel to the display and stored positions o closure 108. Groove 116 is a pivot groove that is wider and shallower than groove 114, and which serves to effect outward pivotal movement of closure 108 through 180 degrees. Detent indentations 118 may be provided, as in ends o grooves 116, to receive a latching member, such as a ball detent.

Figure 9C:
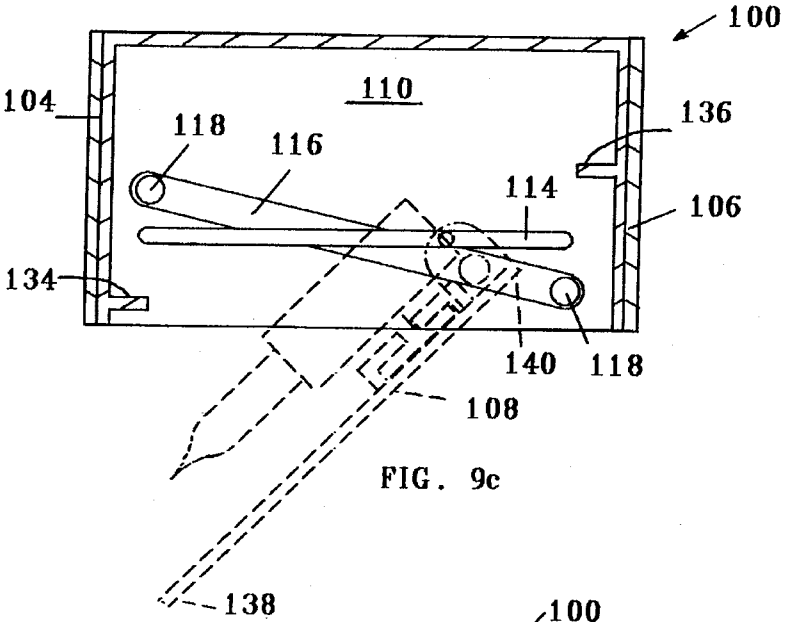
FIGS. 9*a*–9*d* are lateral cut-away views of the embodiment as shown in FIG. 9 illustrating interior structural details of an end closure thereof, with a dashed line depiction of movement of the closure between open and closed positions.
Figure 9D:
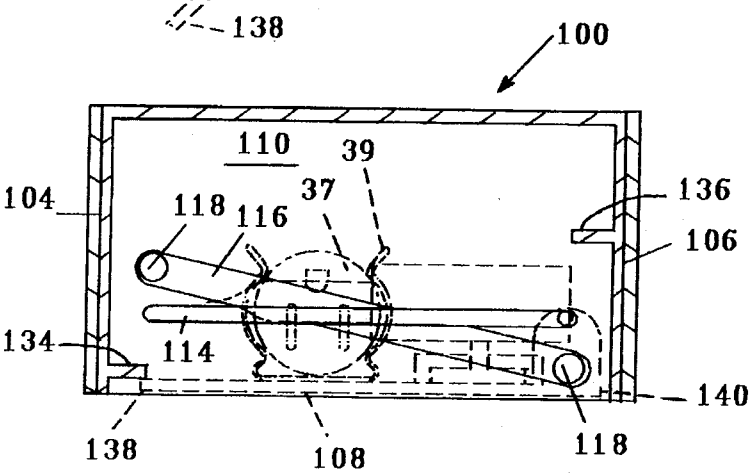
Figure 9A:
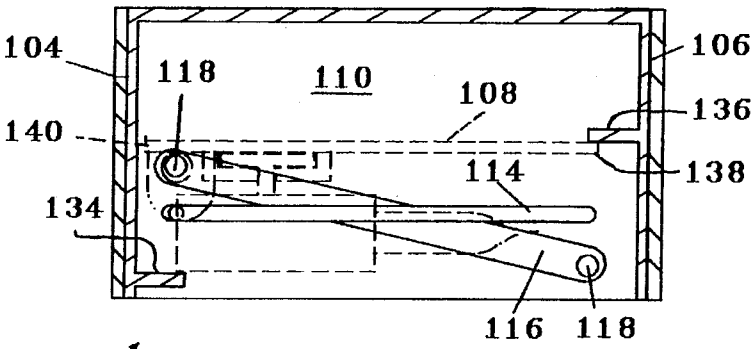
Figure 9B:
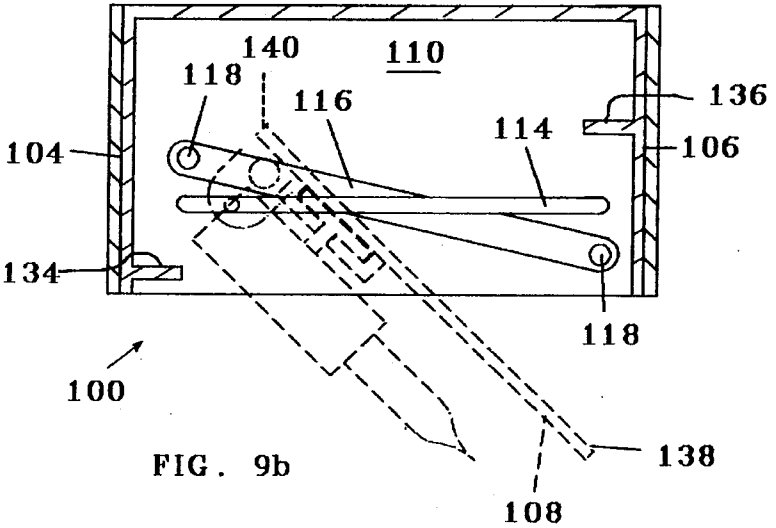
Figure 9:
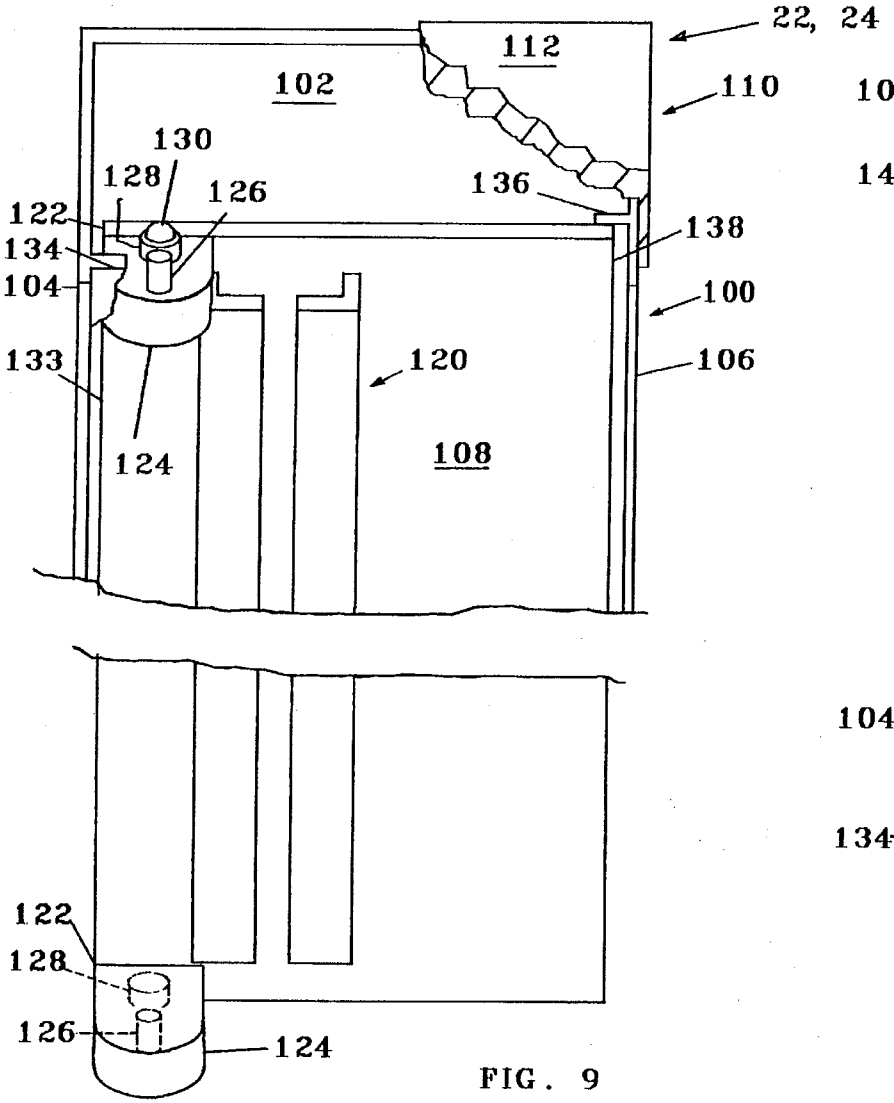
FIG. 9 is a pictorial, broken away view of a light fixture of the present invention adapted for vertical mounting, and showing structural details thereof.

Closure 108 may be constructed, as in the prior described closure 36, as an extruded component having a track 120 (FIG. 9) within which receptacle 52 (FIG. 3), each supporting a respective light socket 54 of a decorative string of lights, are serially mounted as described in the foregoing. At each of corners 122 (FIG. 9) of closure 108 is provided a lug 124, with a pair of guide pin members 126 and 128 set therein, with pins 126 being configured narrower and longer to engage slots 114 of closures 110, and pins 1.28 being configured shorter and wider to engage slots 116 in closures 110. Lug 124 also provides an of#set so as to move the closure laterally within the enclosure. With this configuration, a ball detent 130 may be positioned in one of the pins, such as pin 130, which engages detent indentations 118 in slots 116 to releasably latch closure 108 in either the open position (FIG. 9*a*) or closed position (FIG. 9*d*). As such, pins 126 in grooves 114 at each end of enclosure 100 serve to guide closure 108 straight across the span of the open side of enclosure 100, while pins 128, under the influence of slots 116 at each end of enclosure 100, apply a rotational force to rotate the closure, and a lateral motion to move the closure laterally within enclosure 100. The net result of these motions is a pivoting motion, through 180 degrees, as sequentially shown in FIGS. 9*a*–9*d*, of closure 108 about pins 126 and 128 as closure 108 is moved across the open side of enclosure 100, either presenting the lights for display flush with or slightly recessed within sides of the enclosure, or storing them inside the enclosure with the exterior side of the closure flush with sides of the enclosure. If necessary, lips or ridges 134 and 136 may be provided on inner sides of opposed sides 106 and 104, respectively, for providing a stop for the opened and closed positions. Additionally, if edge 138 of closure 108 is spaced from the inner side of walls 104 and 106 to provide a clearance for the rotational movement as shown in FIGS. 9*a* and 9*b*, lips 134 and 136 serve to close a gap between walls 104 and 106, and edge 138 of closure 108 when the closure is in the opened and closed positions. As no such gap need be present at the opposite edge 140 of closure 108 due to movement carrying this edge away from sides 104 and 106, no such lips are needed to close a gap along this edge. As such, edge 140 may be abutted directly against the inner side of walls 104 and 106. As with the embodiment shown in FIG. 2, other types of pivoting or rotating configurations may be used to pivot or rotate closure 100, such as a single pin centrally mounted at each end of the closure and rotatable within an opening in ends of the enclosure. Here, the closure would simply rotate within the enclosure between open and closed positions. Other types and locations of mounting configurations for the lights may also be used, and the enclosure and receptacle for holding the light sockets may be sized to hold variously sized decorative lights. As described above, plugs and receptacle 37 of the strings of lights may be mounted in spring clips 39, in turn mounted to the interior side of closure 108, so as to become available for connection to an electrical source when closures 108 are rotated to display the lights.

In the instance where closures 108 are to be moved manually, grooves 116 and pins 128 may be omitted, and lugs 124 reduced greatly in size or omitted entirely, with knobs of other like devices provided on closure 108 for conveniently handling the closure during opening and closing. The detents, or other devices, if needed, could be located as necessary on closure 108. Where movement of closure 108 is facilitated mechanically or electrically, grooves 116 and pins 128 serve to positively guide closure 108 through about 180 degrees of motion.

Having disclosed my invention and the manner of its use, it is apparent that incidental modifications may be made thereto without departing from the scope o the following appended claims, wherein I claim:

1. A storage and display fixture comprising:

an elongated enclosure mountable to a structure and further comprising:

a first elongated side having a first inner surface, second and third elongated sides each having second and third inner surfaces, said second and third sides extending from opposed edges of said first side, an end closure for each end of said enclosure exposed to weathering elements, for enclosing each said end, said first, second, third sides and each said end closure forming a housing structure having an open side, a fourth elongated side having a fourth inner surface and coupled in movable relation to said housing structure so that said fourth elongated side is movable to cover said open side or expose at least one of said first inner surface, said second and third inner surfaces, and said fourth inner surface, a string of decorative lights comprising:

a plurality of electrical light bulb sockets coupled together by electrical conductors, each said light bulb socket supporting a decorative light bulb therein, said conductors, said sockets and each said respective light bulb longitudinally positioned along at least one of said first inner surface, said second and third inner surfaces, and said fourth inner surface of said enclosure, whereby said fourth side and said housing structure protectively enclose said light bulb sockets and said decorative light bulbs when said open side is covered by said fourth side, and said fourth side discretely exposes for viewing said light bulb sockets and said light bulbs when said fourth side is moved to expose said inner surface along which said string of decorative lights is positioned.

2. A fixture as set forth in claim 1 further comprising:

a track longitudinally positioned along one of said first, second, third, and fourth inner surfaces, said track having opposed, inwardly extending lips, a plurality of socket receptacles, one of each holding a respective one of said electrical light bulb sockets, and each said receptacle having structure for engaging said track in secure relation.

3. A fixture as set forth in claim 2 wherein said track is positioned along said fourth inner surface of said fourth side.

4. A fixture as set forth in claim 1 wherein said fourth side is longitudinally attached to one of said second and third sides by a hinged region.

5. A fixture as set forth in claim 4 wherein said hinged region comprises an inwardly turned edge of one of said second and third sides to form a first tubular region open along an upper side thereof, and a downwardly turned edge of said fourth side to form a second tubular region open along a lower side thereof, said second tubular region sized to rotate within said first tubular region, whereby pivoting movement is effected between open and closed positions about said first and second tubular regions.

6. A fixture as set forth in claim 1 further comprising first latching means for latching said fourth side in an open position so that said string of lights are viewable, and second latching means for latching said fourth side in a closed position.

7. A fixture as set forth in claim 3 further comprising a first pin extending from a first end of said fourth side, and a second pin co-axial with said first pin and extending from a second end of said fourth side, and first pin engaging means in a first said end closure adjacent said first end for rotatably engaging said first pin, and second pin engaging means in a second said end closure adjacent said second end, for rotatably engaging said second pin, allowing at least rotational movement of said fourth side.

8. A fixture as set forth in claim 7 wherein said first and second pin engaging means further comprises:

a first groove extending longitudinally across an inner side of said first end closure generally in a plane of said open side, a second groove extending longitudinally across an inner side of said second end closure generally in a plane of said opening, and in aligned relation with said first groove, and wherein said pin engaging means further comprises:

a third groove angularly intersecting and passing through said first groove, a third pin offset from a plane of said fourth side and extending from said first end of said fourth side and engaging said third groove, a fourth groove angularly intersecting and passing through said second groove, and in aligned relation with said third groove, a fourth pin offset from a plane of said fourth side and co-axial with said third pin, and extending from said fourth side and engaging said fourth groove, whereby each said first and second groove and each said first and second pins guide said fourth side across said first and second end closures while said third and fourth grooves and said third and fourth pins pivot said fourth side.

9. A fixture as set forth in claim 8 wherein said first and second pins and said third and fourth pins are positioned on longitudinally opposed corners of said fourth side, and are further offset with respect to a plane of said fourth side, whereby pivoting and lateral movement with respect to said enclosure is effected.

10. A storage and display fixture comprising:

an elongated enclosure mountable to a structure and further comprising:

a first elongated side having a first inner surface, second and third elongated sides extending from opposed edges of said first side, and having second and third inner surfaces, respectively, an end closure for each end of said enclosure exposed to weathering elements, for closing each said end, said first, second, third sides and each said end closure forming a housing structure having an open side, a fourth elongated side having a fourth inner surface and further comprising:

a first pin extending from a first end of said fourth side, a second pin coaxial with said first pin and extending from a second end of said fourth side, first pin engaging means in a first said end closure adjacent said first end of said fourth side, for rotatably engaging said first pin, second pin engaging means in a second said end closure adjacent said second end of said fourth side, for rotatable engaging said second pin, allowing rotational movement of said fourth side about said first and second pins between a first, closed position wherein said fourth side closes said opening, and a second position wherein an inner surface of said fourth elongated side is exposed, a track longitudinally positioned along one of said first, second, third, and fourth inner surfaces, track engaging means disposed along said track for supporting a string of decorative lights, whereby said fourth side and said housing structure protectively encloses said string of lights in said first, closed position, and said fourth side discretely exposes for viewing said string of lights in said second position.

11. A storage and display fixture as set forth in claim 10 wherein said track is positioned along said fourth inner surface of said fourth side, and said first pin engaging means comprises a first groove in said first end closure and said second pin engaging means comprises a second groove in said second end closure, said first groove and said second groove extending longitudinally across an inner side of a respective said end closure generally in a plane of said opening, and wherein said first and second end closures each further comprise:

a third groove angularly intersecting and passing through said first groove, a fourth groove angularly intersecting and passing through said second groove, and wherein said fourth side further comprises:

a third pin extending from an end of said fourth side and offset from a plane thereof, said third pin engaging said third groove, a fourth pin coaxially aligned with said third pin and extending from an opposite end of said fourth side, said fourth pin engaging said fourth groove, whereby said first and second grooves and said first and second pins guide said fourth side across said open side while said third and fourth grooves and said third and fourth pins effect rotation of said fourth side.

12. A storage and display fixture as set forth in claim 11 wherein said first pin and said second pin, and said third pin and said fourth pin are positioned on longitudinally opposed corners of said fourth side, and are further offset with respect to a plane of said fourth side, so that said fourth side is pivoted and moved laterally in said housing.

13. A storage and display fixture comprising:

an elongated enclosure mountable to a structure and further comprising:

a first elongated side, second and third elongated sides extending from opposed edges of said first side, an end closure for each end of said enclosure exposed to weathering elements, for enclosing each said end, said first, second, third sides and each said end closure forming a housing structure having an open side, a fourth elongated side movably coupled to one of said second and third sides and movable between a closed position wherein said fourth side closes said opening, and an open position wherein an inner surface of said fourth side is exposed, a string of decorative lights serially mounted along said inner surface of said fourth elongated side, whereby said fourth side and said housing structure protectively enclose said string of decorative lights in said closed position, and said fourth side discretely exposes for viewing said string of decorative lights in said open position.

14. A storage and display fixture as set forth in claim 13 wherein said fourth elongated side is attached to a one of said second and third sides by a hinged region further comprising:

an edge of one of said second and third sides conformed as a first tubular region having a longitudinal first slot extending along an upper region thereof, an edge of said fourth side conformed as a second tubular region sized to rotatably fit within said first tubular region and having a longitudinal second slot extending therealong, for enabling engagement of said second tubular region with said first tubular region.

15. A storage and display fixture as set forth in claim 14 further comprising mating tongue and groove structure on said first tubular region and said second tubular region for releasably locking said fourth side in said open position.

* * * * *